US006834918B2

(12) United States Patent
Park

(10) Patent No.: US 6,834,918 B2
(45) Date of Patent: Dec. 28, 2004

(54) DRAWER FIXING MECHANISM FOR DESK

(76) Inventor: Hyuk-Koo Park, 801-801 Byucksan-Hansung Apt., 1267, Kwonsun-Dong Kwonsun-Gu, Suwon-Si, Kyunggi-Do (KR)

( * ) Notice: Subject to any disclaimer, the term of this patent is extended or adjusted under 35 U.S.C. 154(b) by 0 days.

(21) Appl. No.: 10/390,387

(22) Filed: Mar. 17, 2003

(65) Prior Publication Data

US 2003/0189392 A1 Oct. 9, 2003

(30) Foreign Application Priority Data

Jun. 4, 2002 (KR) ..... 10-2002-0031451

(51) Int. Cl.[7] ..... A47B 17/00
(52) U.S. Cl. ..... 312/195; 108/25
(58) Field of Search ..... 312/194, 195, 312/257.1, 235.9; 108/25, 93, 101

(56) References Cited

U.S. PATENT DOCUMENTS 2,671,002 A * 3/1954 White ..... 108/25
2,709,633 A * 5/1955 Bargen ..... 312/351.4
2,846,285 A * 8/1958 Wright ..... 312/351.4
2,910,803 A * 11/1959 Close ..... 248/345.1
3,256,840 A * 6/1966 Knoblock ..... 108/124
3,561,376 A * 2/1971 Knoblock ..... 108/124
3,758,182 A * 9/1973 Barecki et al. ..... 312/194
4,105,271 A * 8/1978 Sebel et al. ..... 312/280

* cited by examiner

*Primary Examiner*—Peter M. Cuomo
*Assistant Examiner*—Stephen Vu
(74) *Attorney, Agent, or Firm*—Cantor Colburn LLP

(57) ABSTRACT

A drawer fixing mechanism for fixing a drawer to a desk without using screws and rivets is provided. The mechanism prevents the drawer from being deformed, shifted or separated from the desk by impact applied, to the desk. The fixing mechanism comprises a fixing member outwardly extending along upper edges of a drawer and having insertion holes corresponding to the through holes and an insertion groove at its bottom, an intermediate frame combined with a stand, and bots and nuts for assembling elements of the desk. The intermediate frame has a plurality of connection holes formed to correspond to the insertion holes. The bolts are inserted into the through holes of an upper panel, the insertion holes of the fixing member combined with the drawer, and the connection holes of the intermediate frame in order, and the nuts are combined with the respective bolts at the bottom of the intermediate frame.

3 Claims, 4 Drawing Sheets

DRAWER FIXING MECHANISM FOR DESK

BACKGROUND OF THE INVENTION

1. Field of the Invention

The present invention relates to a drawer fixing mechanism for a desk, and more particularly to a drawer fixing mechanism for a desk for fixing a drawer to an upper panel serving as a working place without using screws or rivets but using bolts and nuts, thereby preventing a drawer from being deformed and damaged.

2. Description of the Related Art

Generally, a desk comprises an upper panel providing a working place, a drawer provided under the upper panel and in which books and other items are received, and a stand for supporting the drawer at both sides.

Referring to FIG. 4, a drawer 120 having an interior space 121 therein is secured to the bottom of an upper panel 110 made of wood using screws or rivets.

Since the drawer 120 is fixed to the upper panel 110 by a plurality of screws or rivets, assembling or disassembling work of the desk is complicated and consumes a lot of time. Further, since the bottom surface of the upper panel 110 is usually damaged by such riveting work, the bottom surface of the upper panel cannot be used instead of the upper surface of the panel in the case that the upper surface of the upper panel is damaged.

Accordingly, to solve the problem above, a stand 130 is used. That is, the drawer 120 is simply placed on the stand 130, and the upper panel 110 is placed on the drawer 120. The stand 130 is secured to the bottom surface of the upper panel 110 by bolts and nuts. Therefore, the drawer 120 is not secured to the upper panel 110 and the stands 130. Accordingly, when an external impact is applied to the desk, the drawer 120 is easily separated from the upper panel 110 and/or the drawer 120 can be broken, and the bolt and nut assembly is loosened, so that the upper panel 110 and the stand 130 may be separated.

Further, since the drawer is made of polyvinyl chloride (PVC) resin, it is easily deformed by load etc. and the deformed drawer must be replaced with a new one.

SUMMARY OF THE INVENTION

Therefore, the present invention has been made in view of the above problems, and it is an object of the present invention to provide a drawer fixing mechanism for fixing a drawer to a desk, capable of securely fixing a drawer to a desk without using bolts and nuts.

It is another object of the present invention to provide a fixing mechanism for fixing a drawer to a desk, in which a contact area between a drawer and an upper panel providing a working place is minimized.

It is yet another object of the present invention to provide a fixing mechanism for more securely fixing a reinforcement bar to a drawer.

In accordance with the present invention, the above and other objects can be accomplished by the provision of a drawer fixing mechanism for a desk including an upper panel having a plurality of through holes for receiving bolts, a drawer provided under the upper panel, opened at an upper part and a front part, and having an interior space to receive things therein, and a stand provided under the drawer, the fixing mechanism comprising a fixing member outwardly extending along upper edges of the drawer, and having a plurality of insertion holes penetrating from its upper surface to its lower surface and corresponding to the through holes, and an insertion groove at the bottom thereof for receiving an intermediate frame combined with the stand. The fixing mechanism further comprising the intermediate frame combined with the stand for supporting the drawer and having a plurality of connection holes penetrating therethrough and corresponding to the insertion holes, and bolts and nuts for assembling elements of the desk, wherein the bolts are inserted into the through holes of the upper panel, the insertion holes of the fixing member combined with the drawer, and the connection holes of the intermediate frame in order, and wherein the nuts are combined with the respective bolts at the bottom of the intermediate frame.

Preferably, the fixing protrusions 12*a* may be formed in the insertion groove near its opening.

Preferably, the intermediate frame may have three sides to be opened at its front, and a reinforcement bar may be coupled to both ends of the frame to close the intermediate frame at its front.

Preferably, an upper surface of the fixing member may be rounded.

Preferably, the drawer 120 may have a groove on the bottom surface thereof so as for the reinforcement bar to be inserted into the groove.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

A preferred embodiment of the present invention will be described below in more detail in conjunction with the accompanying drawings.

Figure 1:
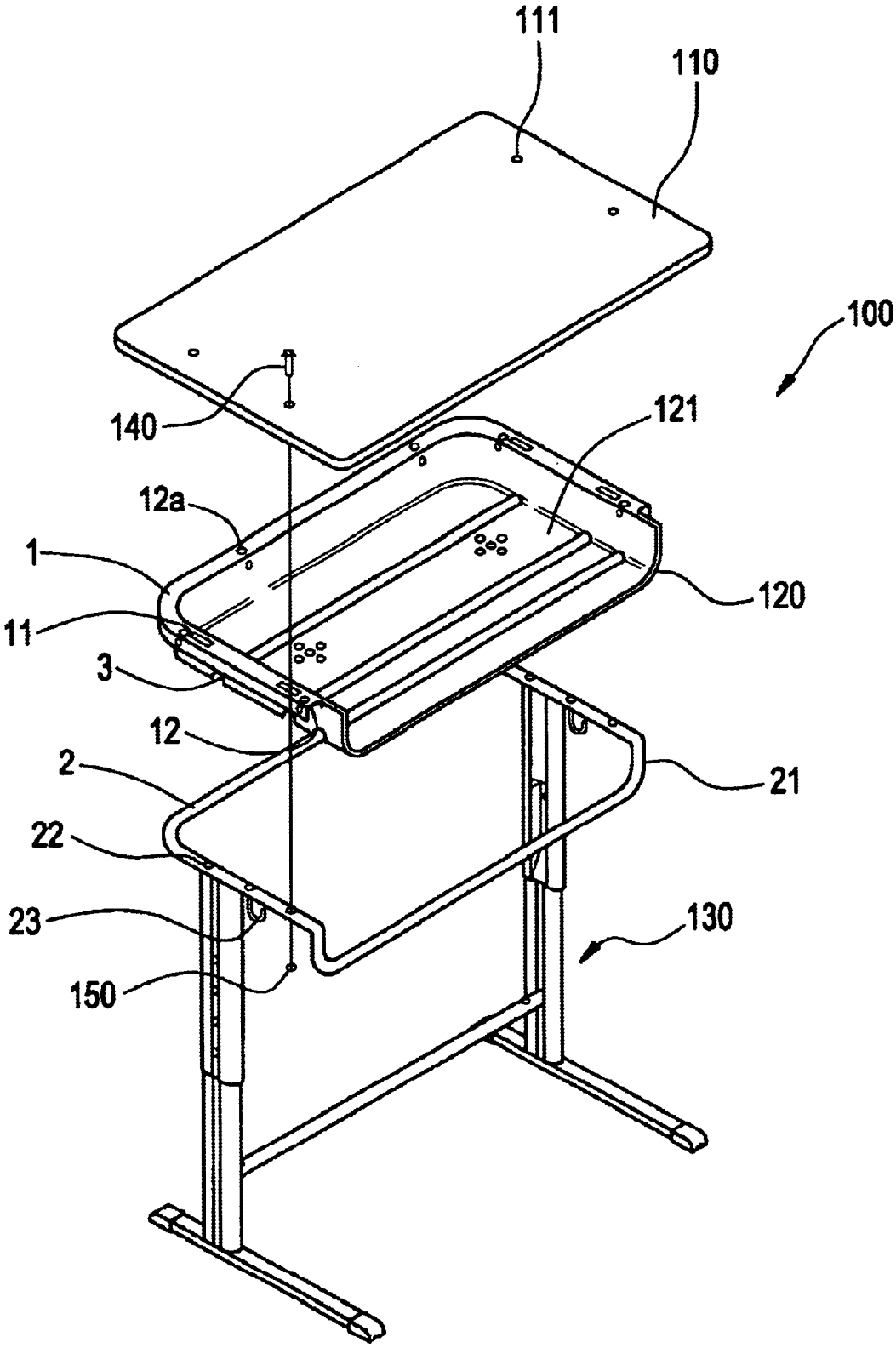
FIG. 1 is an exploded perspective view of a desk having a fixing mechanism in accordance with the present invention.

FIG. 1 illustrates an exploded desk having a fixing mechanism in accordance with the present invention.

Referring to FIG. 1, a desk 100 in accordance with the present invention comprises an upper panel 110, a drawer 120 opened at an upper part and a front part thereof, and having a recess 121 to receive things such as books therein, an intermediate frame 2 received into grooves formed at side edge portions of the drawer 120 and secured to a stand 130, and the stand 130 placed on the ground and supporting the intermediate frame 2 at both sides. Bolts 140 penetrates the upper panel 110, the drawer 120 and the intermediate frame 2 from the upper surface of the upper panel 120 to the bottom of the intermediate frame 2, and nuts 150 are combined with ends of the bolts 140.

The upper panel 110 has a rectangular or a square shape, and has a plurality of through holes 111 at every corner.

The drawer 120 has a plurality of grooves 3 formed at the bottom surface thereof. A fixing member 1 is provided to outwardly extend from upper edge portions of the drawer 120. The fixing member 1 has a plurality of insertion holes 11 penetrating therethrough from its upper surface to its lower surface. The insertion holes 11 are formed to correspond to the through holes 111 of the upper panel 110. The fixing member 1 further has an insertion groove 12 on the bottom thereof. In the insertion groove 12, a plurality of fixing protrusions 12*a* is provided for holding and fixing the intermediate frame 2 in the insertion groove 12 of the fixing member 1. The drawer 120 having a complicated structure described above may be formed by an injection molding method.

The intermediate frame 2 is formed in such a manner as to fit into the insertion groove 12 of the fixing member 1, and has a plurality of connection holes 22 formed to correspond to the insertion holes 11. A hook 23 is provided at the bottom of the intermediate frame 2 between adjacent connection holes 23. The stand 130 is combined with the intermediate frame 2 at a rear part of the intermediate frame 2, and a height of the intermediate frame 2 from the ground is adjusted by adjusting a height of the stand 130.

Further, a reinforcement bar 21 is connected between both ends of the intermediate frame 2 by a welding method and it is inserted into the groove 3 provided on the bottom of the drawer 120 when the drawer 120 is combined with the intermediate frame 2.

Accordingly, for assembling the desk, the intermediate frame 2 is inserted into the insertion groove 12 formed on the bottom of the fixing member 1, the bolts 140 are inserted into the respective through holes 111 of the upper panel 110, the respective insertion holes 11 of the fixing member 1 and the respective connection holes 22 of the intermediate frame 2, and the nuts 150 are coupled to an end of respective bolts 140. In the desk in accordance with the present invention, the intermediate frame 2 is fixed to the drawer 120 along three sides of the drawer 120 by bolts and nuts, so that the drawer 120 is more securely fixed to the stand 130 and the upper panel 110, in comparison with the conventional desk.

Figure 2:
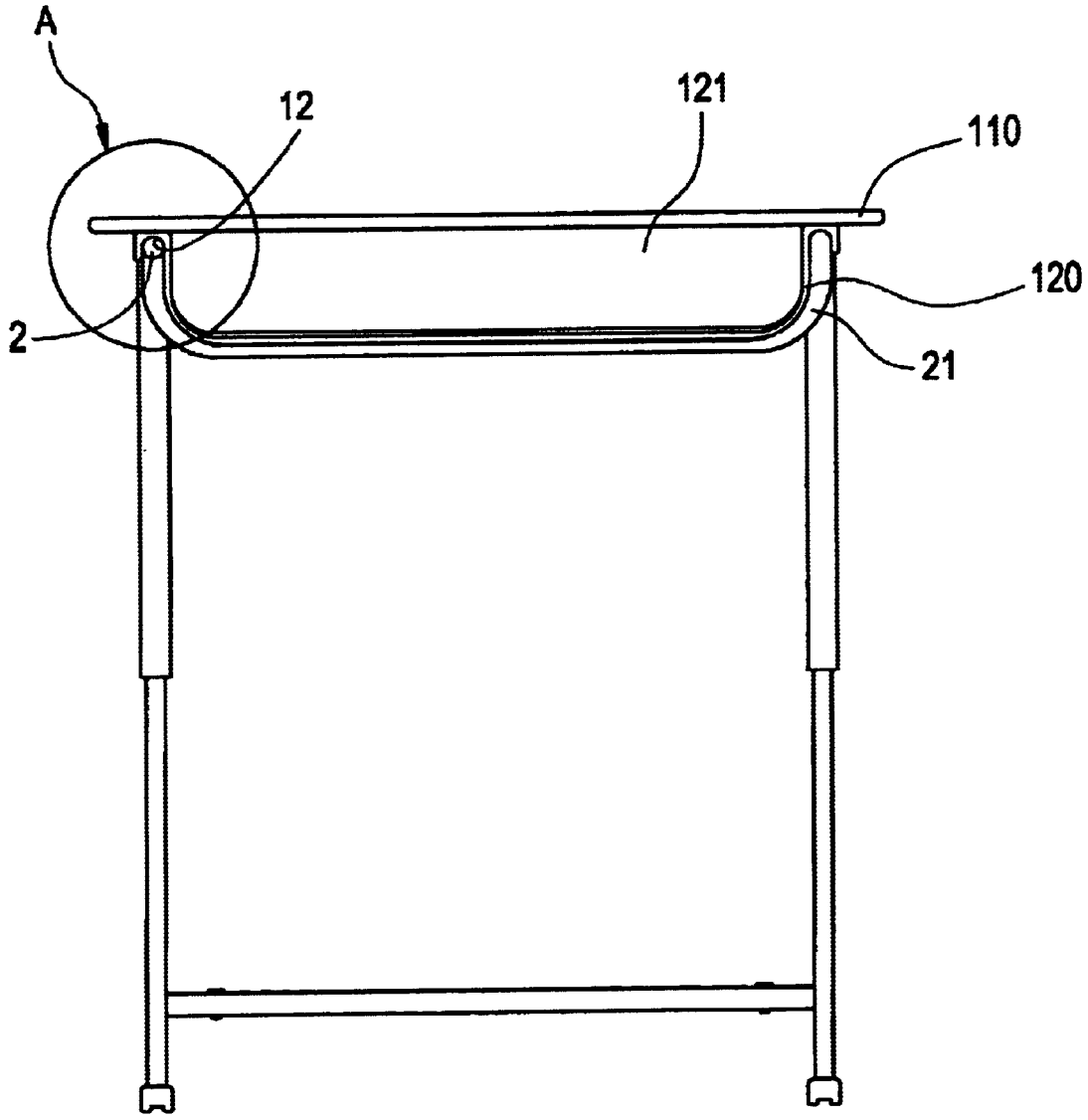
FIG. 2 is a front view of the desk formed by assembling compartments shown in FIG. 1.

FIG. 2 is a front view of the desk in accordance with the present invention. Referring to FIG. 2, when the desk is assembled, the intermediate frame 2 is inserted into the insertion groove 12 formed on the bottom of the fixing member 1 combined with the drawer 120, and the reinforcement bar 21 is received in the groove (not shown) provided on the bottom of the drawer 120. Further, the upper panel 110 is placed on the upper surface of the drawer 120 to cover the recess 121 of the drawer 120.

Accordingly, when an external impact is applied to the desk or things collide with the desk, the reinforcement bar 21 prevents the drawer 120 from being deformed and shifted by being received in the groove (not shown) formed on the bottom of the drawer 120.

Figure 3:
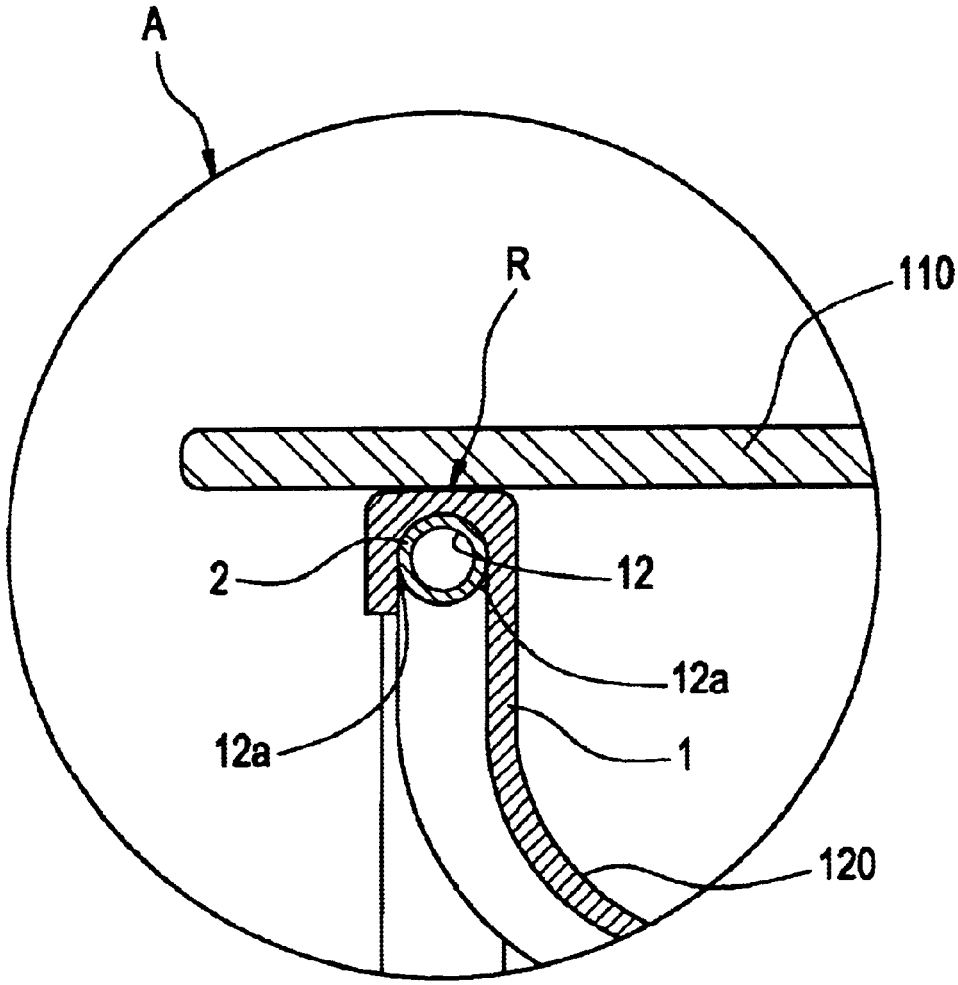
FIG. 3 is an enlarged view of a portion A in FIG. 2.
Figure 4:
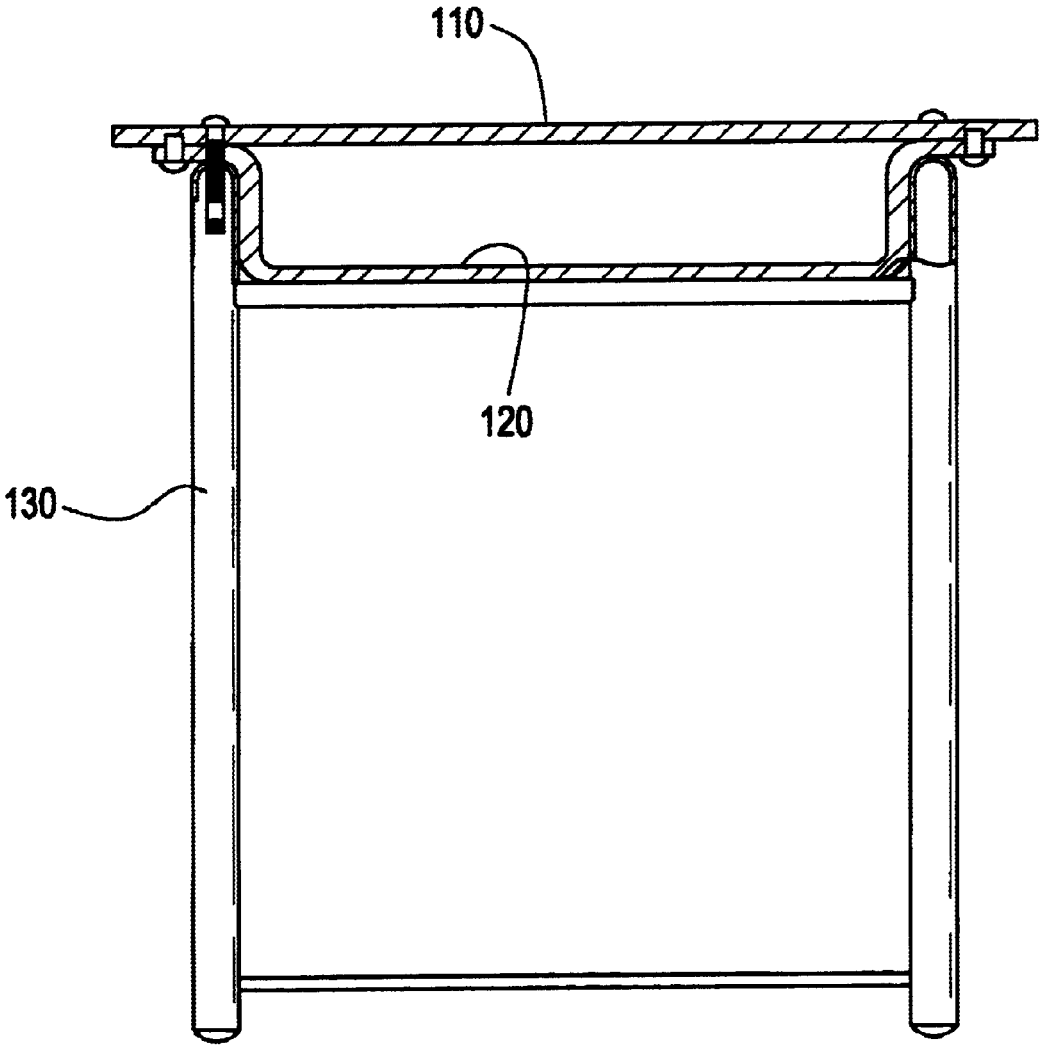
FIG. 4 PRIOR ART
FIG. 4 is a sectional view of a desk in accordance with a conventional art.

FIG. 3 is an enlarged view of an "portion" in FIG. 2. Referring to FIG. 3, the upper surface of the fixing member 1 is rounded (R), and the fixing protrusions 12*a* are formed in the insertion groove 12 at its both end portions. Since the upper surface of the fixing member 1 is round processed (R), a contact area of the fixing member to the bottom surface of the upper panel 110 is minimized. Accordingly, when the upper surface of the upper panel 110 is damaged, the upper panel 110 is turned over so that the bottom surface of the upper panel 110 may be used as a working place.

Further, when the intermediate frame 2 is forcibly inserted into the insertion groove 12 made of elastic material, since the fixing protrusions 12*a* tightly hold the intermediate frame 2 in the insertion groove 12, the drawer 120 is securely fixed to the stand 130 without using rivets or screws.

As described above, the drawer combined with the fixing member is provided under the upper panel, the intermediate frame is inserted into and fixed in the insertion groove provided on the bottom of the fixing member, the stand is installed on the ground and supports the intermediate frame at both sides, bolts penetrate the upper panel, the fixing member combined with the drawer, and the intermediate frame combined with the stand, and are combined with respective nuts, so that the desk can be assembled without using screws and rivets, so that assembling and disassembling works of the desk are simpler and easier than the conventional desk. Further, time for the assembling and disassembling works is reduced.

Further, since the upper surface of the fixing member directly contacting to the upper panel is rounded, the contact area between the fixing member combined with the drawer and the bottom surface of the upper panel is minimized. As a result, damage to the bottom surface of the upper panel is minimized, so that the upper panel may be reused even if the upper surface of the upper panel is damaged, by turning over the upper panel so as for the bottom surface to be used a working place.

Further, since the reinforcement bar is inserted into the groove provided on the bottom of the drawer, the drawer is securely assembled with the intermediate frame and the reinforcement bar. As a result, the drawer may not be deformed or swayed when an external impact is applied to the desk.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A desk comprising an upper panel having a plurality of through holes for receiving a corresponding plurality of bolts, a drawer positioned underneath the upper panel and having an open area as defined by a top section and a front portion of the drawer, wherein the placement of the panel on top of the drawer thereby defining an interior space via the front portion of the drawer in order to receive miscellaneous items, and a stand situated underneath the drawer;

the drawer having a fixing member extending outwardly along upper edges of the drawer, wherein the fixing member having a plurality of insertion holes corresponding to the through holes, the insertion holes being formed to penetrate the fixing member from its upper surface to its bottom surface, and the bottom surface defining an insertion groove for receiving an intermediate frame attached to the stand;

the intermediate frame having a plurality of connection holes corresponding to the insertion holes, and the intermediate frame combined with the stand to support the drawer; and the bolts extending directly into the through holes of the upper panel, the insertion holes of the fixing member, and into the connection holes of the intermediate frame, whereby one of a plurality of nuts is fastened to each of the bolts at the bottom surface of the intermediate frame, and with fixing protrusions forming in the insertion groove.

2. The desk as set forth in claim 1, wherein the intermediate frame has three sides to be opened at its front and a reinforcement bar is coupled to both ends of the frame to close the intermediate frame at the front of the intermediate frame.

3. The desk as set forth in claim 1, wherein the upper surface of the fixing member is rounded.

* * * * *